US012790966B2

(12) United States Patent
Hirose

(10) Patent No.: US 12,790,966 B2
(45) Date of Patent: Nov. 10, 2026

(54) CAMSHAFT MOUNTING STRUCTURE

(71) Applicant: TOYOTA JIDOSHA KABUSHIKI KAISHA, Toyota (JP)

(72) Inventor: Hidetoshi Hirose, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 19/425,250

(22) Filed: Dec. 18, 2025

(65) Prior Publication Data

US 2026/0193996 A1 Jul. 9, 2026

(30) Foreign Application Priority Data

Jan. 9, 2025 (JP) ..... 2025-003661

(51) Int. Cl.
*F01L 1/04* (2006.01)
*F01L 1/047* (2006.01)

(52) U.S. Cl.
CPC ..... *F01L 1/047* (2013.01)

(58) Field of Classification Search
CPC ..... F01L 1/047; F01L 1/46; F01L 2001/0471; F01L 2001/0473; F01L 2001/0476; F01L 2001/054; F02F 7/006; F02F 1/24; F16C 2360/18
See application file for complete search history.

(56) References Cited

U.S. PATENT DOCUMENTS 4,709,667 A * 12/1987 Ichihara ..... F01M 9/10 123/90.34
4,823,747 A * 4/1989 Wagner ..... F02F 1/38 123/193.5
5,564,837 A * 10/1996 Putnam ..... F02F 7/0053 384/429
7,032,554 B2 * 4/2006 Lee ..... F01L 1/022 123/90.6
8,042,506 B2 * 10/2011 Shoji ..... F01L 1/053 123/193.5
8,042,509 B2 * 10/2011 Shoji ..... F01L 1/053 123/193.5
8,418,670 B2 * 4/2013 Abe ..... F16C 9/02 123/195 A
8,656,877 B2 * 2/2014 Hiramatsu ..... F01M 9/104 123/90.34
2002/0073546 A1 * 6/2002 Thompson ..... F16C 17/02 29/898

(Continued)

FOREIGN PATENT DOCUMENTS

JP 2016-008559 A 1/2016

*Primary Examiner* — Dapinder Singh
(74) *Attorney, Agent, or Firm* — Finnegan, Henderson, Farabow, Garrett & Dunner LLP

(57) ABSTRACT

A camshaft mounting structure includes a cylinder head body including at least a pair of head body bolt holes arranged in parallel, a first cam cap fastened in contact with the cylinder head body, and a second cam cap fastened in contact with the first cam cap. The first cam cap includes a pair of first cam cap bolt holes positionally corresponding to the pair of head body bolt holes, and a first support recess for supporting a camshaft. The second cam cap includes a pair of second cam cap bolt holes positionally corresponding to the pair of first cam cap bolt holes, and a second support recess supporting the camshaft together with the first support recess.

4 Claims, 6 Drawing Sheets

(56) References Cited

U.S. PATENT DOCUMENTS

| | | | | |
|---|---|---|---|---|
| 2010/0012063 | A1* | 1/2010 | Shoji | F01L 1/053<br>123/90.37 |
| 2015/0377088 | A1 | 12/2015 | Fujiwara et al. | |
| 2017/0101909 | A1* | 4/2017 | Beyer | F01L 1/34 |
| 2017/0254230 | A1* | 9/2017 | Madin | F01L 1/047 |

* cited by examiner

CAMSHAFT MOUNTING STRUCTURE

CROSS-REFERENCE TO RELATED APPLICATION

This application is based upon and claims the benefit of priority of the prior Japanese Patent Application No. 2025-003661, filed on Jan. 9, 2025, the entire contents of which are incorporated herein by reference.

TECHNICAL FIELD

The present disclosure relates to a camshaft mounting structure.

BACKGROUND

Conventionally, there is known a structure in which an intake camshaft and an exhaust camshaft are rotatably supported by a cylinder head body and cam caps assembled to the cylinder head body (for example, see Japanese Patent Application Publication No. 2016-008559). In the structure proposed in Japanese Patent Application Publication No. 2016-008559, when the cylinder head body and the cam cap are fastened to each other, a pin ring as a positioning member for positioning the cylinder head body and the cam cap is press-fitted into each of the cylinder head body and the cam cap.

The camshaft may be removed after being attached to the cylinder head body. In this case, the cam caps are removed from the cylinder head body. When the camshaft is attached to the cylinder head body again, the cam caps are attached to the cylinder head body again. It is considered that such a re-attachment operation of the cam cap is difficult unless the positioning member is provided in a state of being loosely fittable to the cylinder head body and the cam cap. Here, the loose fit is a state in which a member is inserted into a mounting hole with a clearance provided between an outer peripheral wall surface of the member and an inner peripheral wall surface of the mounting hole. In the proposal of Japanese Patent Application Publication No. 2016-008559, pin rings as positioning members used for positioning the cylinder head body and the cam cap are press-fitted into both of them. That is, the pin ring is mounted on the cylinder head body or the cam cap in a state where the entire outer peripheral wall surface of the pin ring is in close contact with the inner peripheral wall surface of the mounting hole. Therefore, when the proposal of Japanese Patent Application Publication No. 2016-008559 is adopted, it is considered that the work of attaching the cam cap again becomes difficult.

However, if the ease of the re-attachment operation of the cam cap is emphasized and the structure in which the positioning member is loosely fitted is adopted, the positional deviation of the cam cap might occur every time the attachment operation of the cam cap is performed. When the cam cap is displaced, a clearance between the camshaft and the cam cap is reduced, and seizure resistance and friction performance might be deteriorated.

SUMMARY

It is therefore an object of the present disclosure to provide a camshaft mounting structure which facilitates re-mounting of a cam cap and positioning of the cam cap.

The above object is achieved by a camshaft mounting structure including: a cylinder head body including at least a pair of head body bolt holes arranged in parallel; a first cam cap, fastened in contact with the cylinder head body, including: a pair of first cam cap bolt holes positionally corresponding to the pair of head body bolt holes; and a first support recess for supporting a camshaft; and a second cam cap, fastened in contact with the first cam cap, including: a pair of second cam cap bolt holes positionally corresponding to the pair of first cam cap bolt holes; and a second support recess supporting the camshaft together with the first support recess, wherein the cylinder head body, the first cam cap, and the second cam cap are fastened by fastening bolts, the fastening bolt is inserted through the first cam cap bolt hole and the second cam cap bolt hole and is screwed into a screw thread portion provided in the head body bolt hole, a first positioning member having a cylindrical shape is disposed at a contact portion between the cylinder head body and the first cam cap so as to extend over an opening of the head body bolt hole and a first opening of the first cam cap bolt hole facing the opening of the head body bolt hole, one of an inner diameter of the opening of the head body bolt hole and an inner diameter of the first opening of the first cam cap bolt hole in which the first positioning member is disposed is larger than another of the inner diameter of the opening of the head body bolt hole and the inner diameter of the first opening of the first cam cap bolt hole, a minimum distance between the openings of the pair of head body bolt holes is different from a minimum distance between the first openings of the pair of first cam cap bolt holes, and an outer peripheral wall surface of the first positioning member is in contact with a part of an inner peripheral wall surface of the one of the opening of the head body bolt hole and the first opening of the first cam cap bolt hole.

The above camshaft mounting structure may further includes a second positioning member having a cylindrical shape and disposed at a contact portion between the first cam cap and the second cam cap so as to extend over a second opening of the first cam cap bolt hole and an opening of the second cam cap bolt hole facing the second opening of the first cam cap bolt hole, wherein one of an inner diameter of the second opening of the first cam cap bolt hole and an inner diameter of the opening of the second cam cap bolt hole in which the second positioning member is disposed may be larger than another of the inner diameter of the second opening of the first cam cap bolt hole and the inner diameter of the opening of the second cam cap bolt hole, a minimum distance between the second openings of the pair of first cam cap bolt holes may be different from a minimum distance between the openings of the pair of second cam cap bolt holes, and an outer peripheral wall surface of the second positioning member may be in contact with a part of an inner peripheral wall surface of the one of the second opening of the first cam cap bolt hole and the opening of the second cam cap bolt hole.

In the above camshaft mounting structure, the pair of first cam cap bolt holes may be arranged to sandwich the first support recess, and the pair of second cam cap bolt holes may be arranged to sandwich the second support recess.

In the above camshaft mounting structure, wherein when the minimum distance between the openings of the pair of head body bolt holes is shorter than the minimum distance between the first openings of the pair of first cam cap bolt holes, a distance between central axes of the pair of head body bolt holes may be shorter than a distance between central axes of the pair of first cam cap bolt holes.

DETAILED DESCRIPTION

Figure 1:
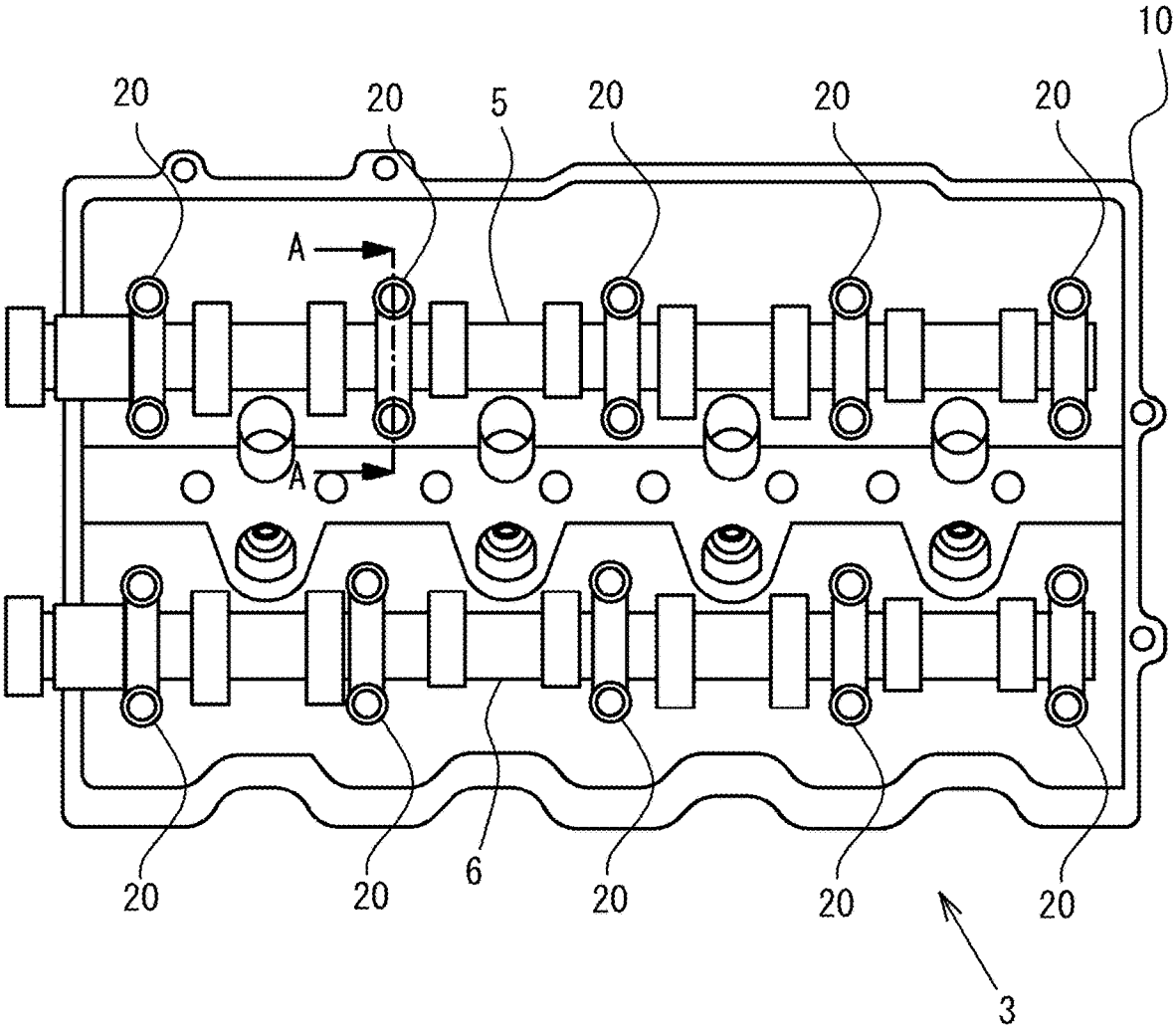
FIG. 1 is a plan view of a cylinder head to which a camshaft mounting structure according to an embodiment is applied.

Hereinafter, an embodiment of the present disclosure will be described with reference to the accompanying drawings. However, in the drawings, the dimensions, ratios, and the like of the respective parts may not be illustrated so as to completely match the actual ones. In addition, some drawings may be drawn with details omitted. In addition, the dimensional relationship of each part may be exaggerated in order to illustrate the features of the embodiment in an easily understandable manner.

Embodiment

First, a schematic configuration of a cylinder head 3 to which a camshaft mounting structure of an embodiment is applied will be described with reference to FIG. 1. The cylinder head 3 includes an intake camshaft 5 and an exhaust camshaft 6 attached to a cylinder head body 10. The intake camshaft 5 and the exhaust camshaft 6 are arranged such that their axial directions are parallel to each other. The intake camshaft 5 and the exhaust camshaft 6 are rotatably held by a plurality of cam caps 20 provided at intervals in the axial direction. The cam caps 20 each form a journal.

Figure 2A:
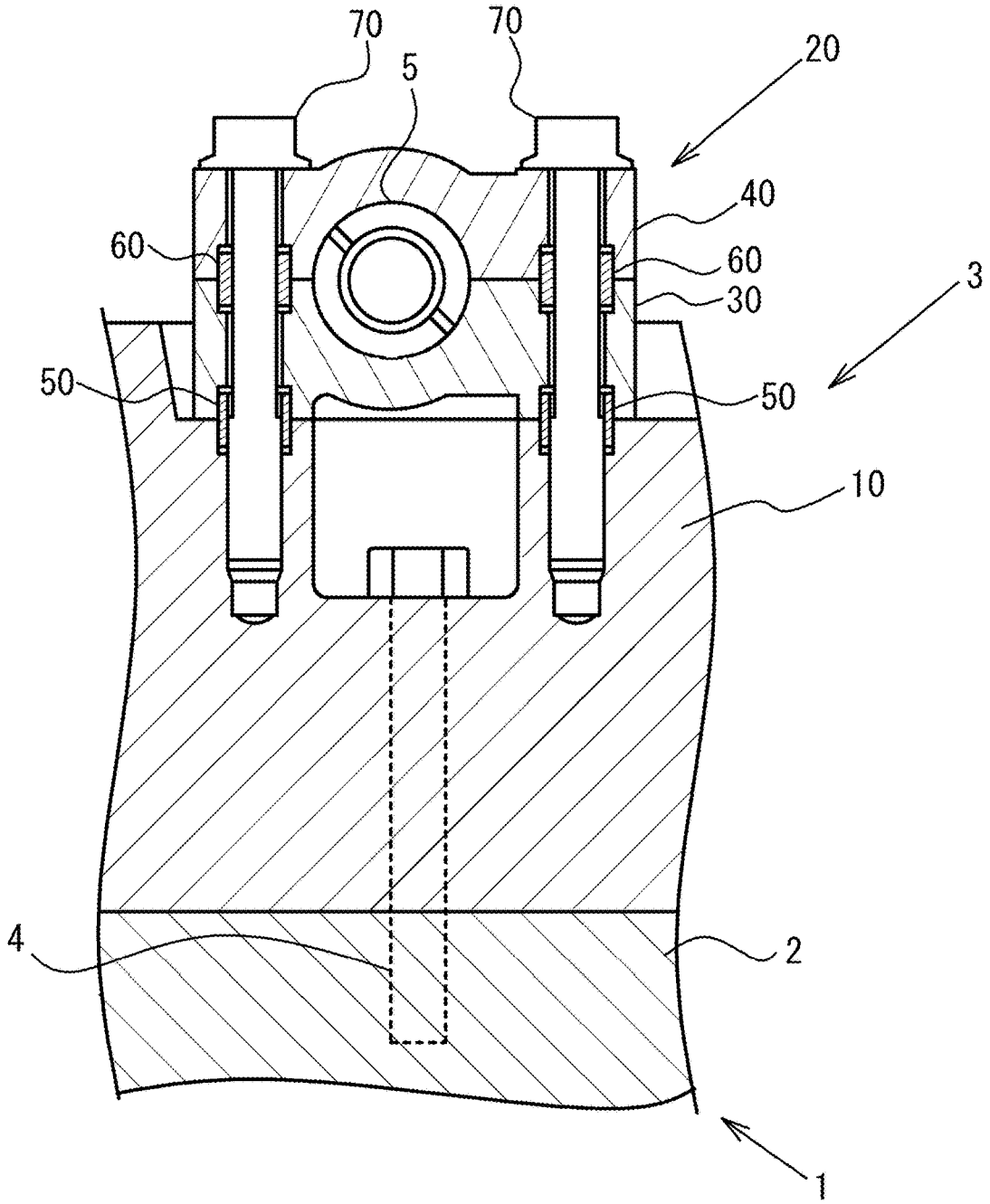
FIG. 2A is a partially enlarged sectional view taken along line A-A in FIG. 1.
Figure 3:
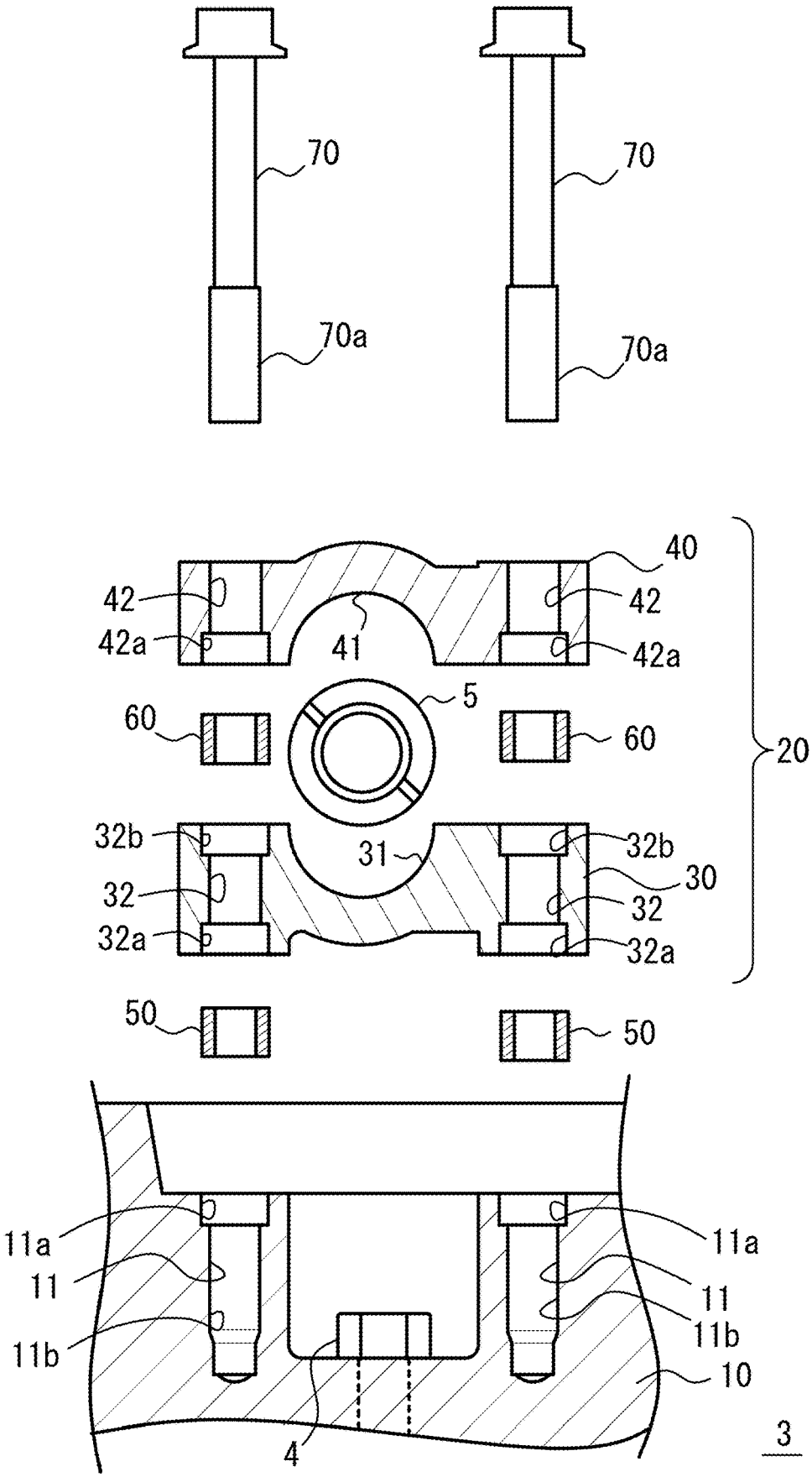
FIG. 3 is an exploded view of a mounting portion of a camshaft of the embodiment.

Referring to FIGS. 3 and 2A, the intake camshaft 5 is rotatably supported by the cam cap 20 attached to the cylinder head body 10. Since the mounting structure of the intake camshaft 5 and the mounting structure of the exhaust camshaft 6 are common, the mounting structure of the intake camshaft 5 will be described in the following description. In the following description, the intake camshaft 5 is simply referred to as the camshaft 5.

Referring to FIG. 2A, the cylinder head body 10 of the cylinder head 3 is fastened to a cylinder block 2 by a head bolt 4. In the present embodiment, the work of fastening and loosening the head bolt 4 is facilitated by removing the cam cap 20.

The cylinder head body 10 includes head body bolt holes 11. In the present embodiment, two head body bolt holes 11 are provided for the single cam cap 20. The two head body bolt holes 11 are arranged in parallel and provided in pairs. The head body bolt holes 11 are provided so as to be located on both sides with respect to the camshaft 5. The head body bolt hole 11 is a bottomed hole, and includes an opening 11*a* and a screw thread portion 11*b* provided on a side close to a bottom portion.

Figure 4:
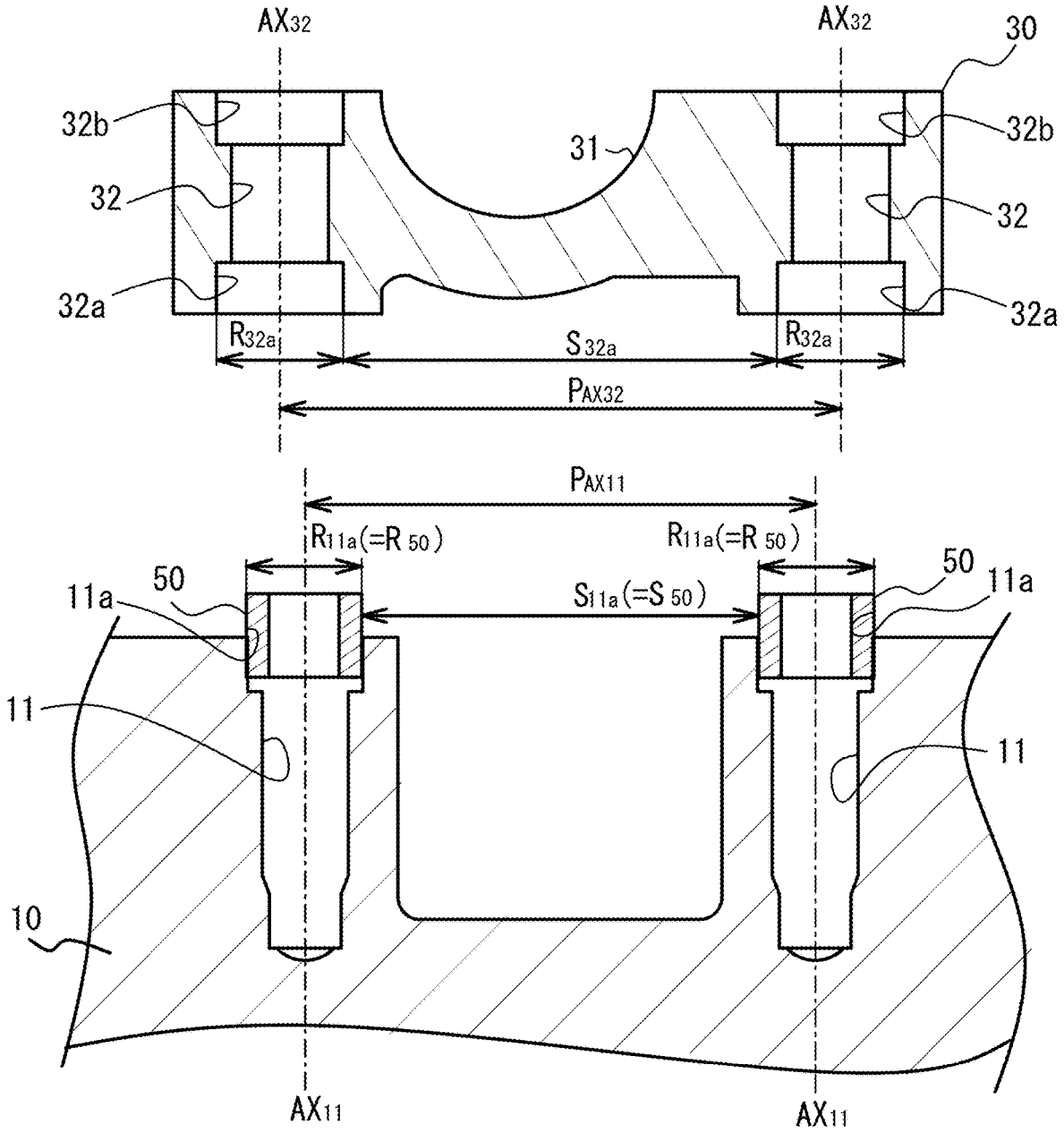
FIG. 4 is an explanatory view illustrating a dimensional relationship of each part in a contact portion between a cylinder block body and a first cam cap.

Referring to FIG. 4, each of the head body bolt holes 11 has a central axis $AX_{11}$. A distance between the central axes of the pair of head body bolt holes 11 is $P_{AX11}$. An inner diameter of the opening 11*a* of the head body bolt hole 11 is $R_{11a}$. The minimum distance between the opening 11*a* of the pair of head body bolt holes 11 is $S_{11a}$.

Referring again to FIGS. 2A and 3, the cam cap 20 includes a first cam cap 30 and a second cam cap 40. The first cam cap 30 may be referred to as a lower cam cap. The second cam cap 40 may be referred to as an upper cam cap.

The first cam cap 30 includes a first support recess 31 that supports the camshaft 5. The first cam cap 30 includes first cam cap bolt holes 32. The first cam cap bolt holes 32 are provided positionally corresponding to the pair of head body bolt holes 11. Thus, the first cam cap 30 includes the pair of first cam cap bolt holes 32. The pair of first cam cap bolt holes 32 are arranged to sandwich the first support recess 31.

The first cam cap bolt holes 32 are all insertion holes, and each include a first opening 32*a* and a second opening 32*b*. The first opening 32*a* faces the opening 11*a* of the head body bolt hole 11. The second opening 32*b* faces an opening 42*a* of a second cam cap bolt hole 42 described later.

The second cam cap 40 includes a second support recess 41 that supports the camshaft 5 together with the first support recess 31 included in the first cam cap 30. The second cam cap 40 includes the second cam cap bolt holes 42. The second cam cap bolt holes 42 are provided positionally corresponding to the pair of first cam cap bolt holes 32. Thus, the second cam cap 40 includes a pair of second cam cap bolt holes 42. The pair of second cam cap bolt holes 42 are arranged to sandwich the second support recess 41.

Each of the second cam cap bolt holes 42 is an insertion hole and includes the opening 42*a*. The opening 42*a* faces the second opening 32*b* of the first cam cap bolt hole 32.

Figure 5:
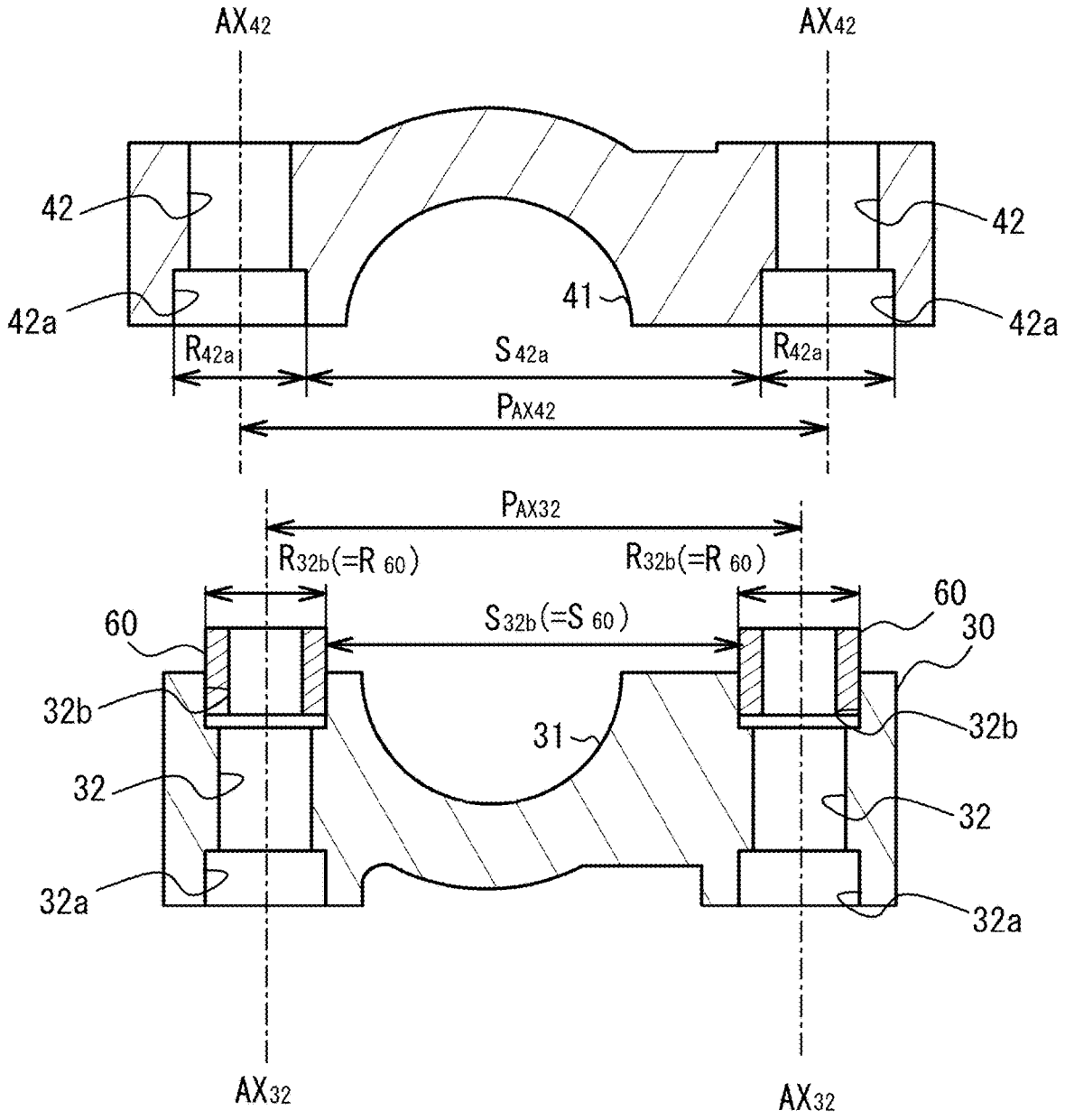
FIG. 5 is an explanatory view illustrating a dimensional relationship of each portion at a contact portion between the first cam cap and a second cam cap.

Referring to FIG. 4, each of the first cam cap bolt holes 32 has a central axis $AX_{32}$. A distance between the center axes of the pair of first cam cap bolt holes 32 is $P_{AX32}$. An inner diameter of the first opening 32*a* of the first cam cap bolt hole 32 is $R_{32a}$. The minimum distance between the first openings 32*a* of the pair of first cam cap bolt holes 32 is $S_{32a}$. Referring to FIG. 5, an inner diameter of the second opening 32*b* of the first cam cap bolt hole 32 is $R_{32b}$. The minimum distance between the second openings 32*b* of the pair of first cam cap bolt holes 32 is $S_{32b}$.

Referring to FIG. 5, each of the second cam cap bolt holes 42 has a central axis $AX_{42}$. A distance between the center axes of the pair of second cam cap bolt holes 42 is $P_{AX42}$. An inner diameter of the opening 42*a* of the second cam cap bolt hole 42 is $R_{42a}$. The minimum distance between the openings 42*a* of the pair of second cam cap bolt holes 42 is $S_{42a}$.

Referring again to FIG. 3, a pin ring 50 as a first positioning member is disposed between the opening 11*a* of the head body bolt hole 11 and the first opening 32*a* of the first cam cap bolt hole 32. A pin ring 60 as a second positioning member is disposed between the second opening 32*b* of the first cam cap bolt hole 32 and the opening 42*a* of the second cam cap bolt hole 42.

Figure 2B:
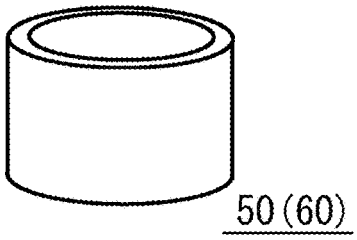
FIG. 2B is a perspective view of a pin ring as first and second positioning members.

In the present embodiment, the pin ring 50 and the pin ring 60 are the same. The pin rings 50 and 60 are cylindrical members as illustrated in FIG. 2B.

Referring to FIG. 4, an end of the pin ring 50 is press-fitted into the opening 11*a* of the head body bolt hole 11.

Therefore, an outside diameter $R_{50}$ of the pin ring 50 is the same as the inner diameter $R_{11a}$ of the opening 11*a* of the head body bolt hole 11. The minimum distance $S_{50}$ between the outer wall surfaces of the pair of the pin rings 50 is the same as the minimum distance $S_{11a}$ between the openings 11*a* of the pair of head body bolt holes 11. The other end of the pin ring 50 is loosely fitted into the first opening 32*a* of the first cam cap bolt hole 32. The outer peripheral wall surface of the other end of the pin ring 50 is in contact with a part of the inner peripheral wall surface of the first opening 32*a* of the first cam cap bolt hole 32.

Referring to FIG. 5, an end of the pin ring 60 is press-fitted into the second opening 32*b* of the first cam cap bolt hole 32. Therefore, an outer diameter $R_{60}$ of the pin ring 60 is the same as the inner diameter $R_{32b}$ of the second opening 32*b* of the first cam cap bolt hole 32. Further, the minimum distance $S_{60}$ between the outer wall surfaces of the pair of the pin rings 60 is the same as the minimum distance $S_{32b}$ between the second openings 32*b* of the pair of first cam cap bolt holes 32. The other end of the pin ring 60 is loosely fitted into the opening 42*a* of the second cam cap bolt hole 42. The outer peripheral wall surface of the other end of the pin ring 60 is in contact with a part of the inner peripheral wall surface of the opening 42*a* of the second cam cap bolt hole 42.

A fastening bolt 70 is inserted into the first cam cap bolt hole 32 and the second cam cap bolt hole 42, and a screw thread portion 70*a* provided on an end of the fastening bolt 70 is screwed to the screw thread portion 11*b* provided in the head body bolt hole 11. At this time, the fastening bolt 70 passes through the inside of the pin ring 50 and the pin ring 60. Thus, the cam cap 20 including the first cam cap 30 and the second cam cap 40 is fastened to the cylinder head body 10 while supporting the camshaft 5.

Next, the dimensional relationship of each part will be described in detail with reference to FIG. 4 to FIG. 6B. An inner diameter $R_{11a}$ of the opening 11*a* of head body bolt hole 11 is smaller than an inner diameter $R_{32a}$ of the first opening 32*a* of the first cam cap bolt hole 32. That is, the inner diameter $R_{11a}$ and the inner diameter $R_{32a}$ have a relationship of $R_{11a}$ $(=R_{50})<R_{32a}$. This is because the end of the pin ring 50 is press-fitted into the opening 11*a* of the head body bolt hole 11, and the other end of the pin ring 50 is loosely fitted into the first opening 32*a* of the first cam cap bolt hole 32.

When the minimum distance Sia between the openings 11*a* of the pair of head body bolt holes 11 is compared with minimum distance $S_{32a}$ between the first openings 32*a* of the pair of first cam cap bolt holes 32, the minimum distance Sua is shorter than the minimum distance $S_{32a}$. That is, the minimum distances $S_{11a}$ $(=S_{50})$ and $S_{32a}$ have a relationship of $S_{11a}$ $(=S_{50})<S_{32a}$.

In the present embodiment, in order to set such a dimensional relationship, the distance$_{AX11}$ between the center axes of the pair of head body bolt holes 11 is set to be shorter than the distance$_{AX32}$ between the center axes of the pair of first cam cap bolt holes 32.

Figure 6A:
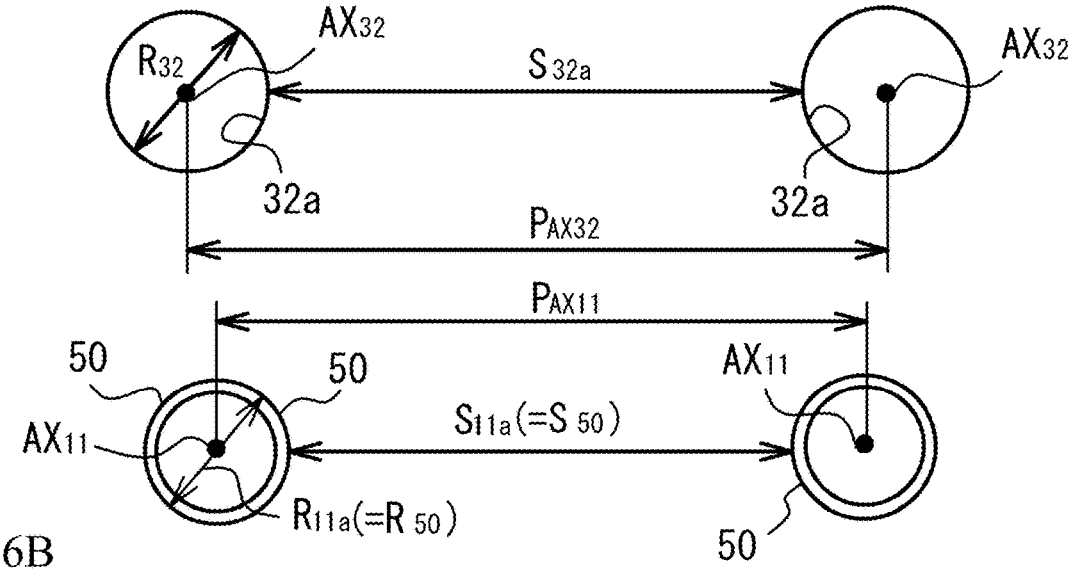
FIG. 6A is an explanatory view illustrating the dimensions and arrangement of openings of the head body bolt hole and openings of the first cam cap bolt hole in the embodiment.
Figure 6B:
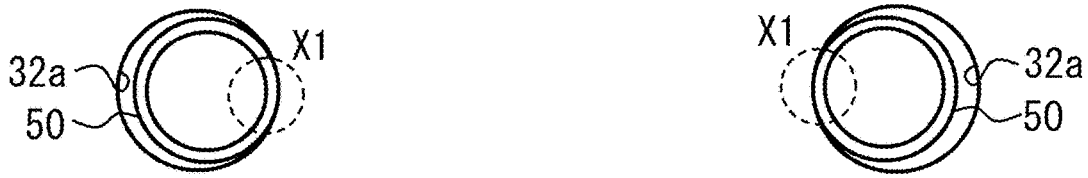
FIG. 6B is an explanatory view schematically illustrating a state where an outer peripheral wall surface of a pin ring is in contact with an inner peripheral wall surface of the opening of a first cam cap bolt hole.

In the present embodiment, since the relationship of $S_{11a}<S_{32a}$ is satisfied, the outer peripheral wall surface of the pin ring 50 and the inner peripheral wall surface of the first opening 32*a* of the first cam cap bolt hole 32 are capable of being in contact with each other (see regions X1 in FIG. 6B). Therefore, the first cam cap 30 is positioned with respect to the cylinder head body 10. At this time, since the relationship of $R_{11a}$ $(=R_{50})<R_{32a}$ is satisfied, a clearance is formed between the outer peripheral wall surface of the pin ring 50 and the inner peripheral wall surface of the first opening 32*a* of the first cam cap bolt hole 32. This facilitates insertion of the pin ring 50 into the first opening 32*a* of the first cam cap bolt hole 32. That is, the first cam cap 30 is easily attached to the cylinder head body 10.

The regions X1 are located inside between the respective central axes.

Such a relationship is also maintained in the relationship between the first cam cap 30 and the second cam cap 40. Referring to FIG. 5, the inner diameter $R_{32b}$ of the second opening 32*b* of the first cam cap bolt hole 32 is smaller than the inner diameter $R_{42a}$ of the opening 42*a* of the second cam cap bolt hole 42. That is, the inner diameter $R_{32b}$ and the inner diameter $R_{42a}$ have a relationship of $R_{32b}$ $(=R_{60})<R_{42a}$. This is because an end of the pin ring 60 is press-fitted into the second opening 32*b* of the first cam cap bolt hole 32, and the other end of the pin ring 60 is loosely fitted into the opening 42*a* of the second cam cap bolt hole 42.

When the minimum distance $S_{32b}$ between the second openings 32*b* of the pair of first cam cap bolt holes 32 is compared with minimum distance $S_{42a}$ between the openings 42*a* of the pair of second cam cap bolt holes 42, the minimum distance $S_{32}$b is shorter than the minimum distance $S_{42a}$. That is, the minimum distances $S_{32b}$ and $S_{42a}$ have a relationship of $S_{32b}<S_{42a}$.

In the present embodiment, in order to set such a dimensional relationship, the distance $P_{AX32}$ between the center axes of the pair of first cam cap bolt holes 32 is set to be shorter than the distance $P_{AX42}$ between the center axes of the pair of second cam cap bolt holes 42.

In the present embodiment, the relationship of $S_{32b}<S_{42a}$ is satisfied, and thus the outer peripheral wall surface of the pin ring 60 and the inner peripheral wall surface of the opening 42*a* of the second cam cap bolt hole 42 are capable of being in contact with each other (not illustrated). Therefore, the second cam cap 40 is positioned with respect to the first cam cap 30. At this time, since the relationship of $R_{32b}$ $(=R_{60})<R_{42a}$ is satisfied, a clearance is formed between the outer peripheral wall surface of the pin ring 60 and the inner peripheral wall surface of the opening 42*a* of the second cam cap bolt hole 42. This facilitates insertion of the pin ring 60 into the opening 42*a* of the second cam cap bolt hole 42. That is, the second cam cap 40 is easily attached to the first cam cap 30.

In the present embodiment, when the first cam cap 30 is removed from the cylinder head body 10, it is not needed to pull out the pin ring 50, which is press-fitted into the opening 11*a* of the head body bolt hole 11, from the opening 11*a*. Therefore, when the first cam cap 30 is attached to the cylinder head body 10 again, it is not needed to press-fit the pin ring 50 in to the opening 11*a* again.

Similarly, when the second cam cap 40 is removed from the first cam cap 30, it is not needed to pull out the ring pin 60, which is press-fitted into the second opening 32*b* of the first cam cap bolt hole 32, from the second opening 32*b*. Therefore, when the second cam cap 40 is attached to the first cam cap 30 again, it is not needed to press-fit the ring pin 60 into the second opening 32*b* again.

The pin ring 50 may be press-fitted into the first opening 32*a* of the first cam cap bolt hole 32 and may be loosely fitted into the opening 11*a* of the head body bolt hole 11. Similarly, the pin ring 60 may be press-fitted into the opening 42*a* of the second cam cap bolt hole 42 and may be loosely fitted into the second opening 32*b* of the first cam cap bolt hole 32.

Further, one of the pin rings 50 may be press-fitted into one of the first openings 32*a* of the pair of first cam cap bolt holes 32, the other of the pin rings 50 may be loosely fitted into the other of the first openings 32*a*. At this time, one of the pin rings 50 is loosely fitted into one of the openings 11*a* of the corresponding pair of head body bolt holes 11, and the other of the pin rings 50 is press-fitted into the other of the openings 11*a*. Similarly, one of the pin rings 60 may be press-fitted into one of the openings 42*a* of the pair of second cam cap bolt holes 42, and the other of the pin rings 60 may be loosely fitted into the other of the openings 42*a*. At this time, one of the pin rings 60 is loosely fitted into one of the second openings 32*b* of the pair of corresponding first cam cap bolt holes 32, and the other of the ring pins 60 is press-fitted into the other of the second openings 32*b*.

In short, the pin ring 50 and the pin ring 60 may be arranged in a manner that the end is press-fitted and the other end is loosely fitted.

In the present embodiment, each of the pair of head body bolt holes 11, the pair of first cam cap bolt holes 32, and the pair of second cam cap bolt holes 42 is provided so as to be located on both sides with respect to the camshaft 5. However, the pair of bolt holes may be disposed on one side of the camshaft 5. Further, in addition to the pair of bolt holes, another bolt hole may be provided.

Although the cam caps 20 of the present embodiment are configured to support either one of the intake camshaft 5 and the exhaust camshaft 6 separately, the cam caps may be configured to support both the intake camshaft 5 and the exhaust camshaft 6.

Figure 6C:
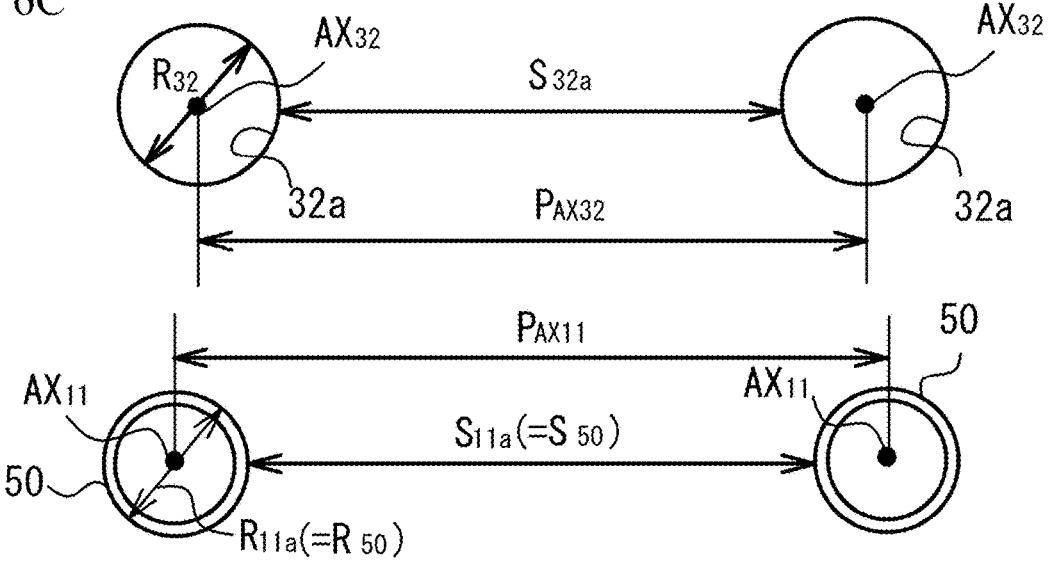
FIG. 6C is an explanatory view illustrating the dimensions and arrangement of openings of the head body bolt hole and openings of the first cam cap bolt hole in a variation.
Figure 6D:
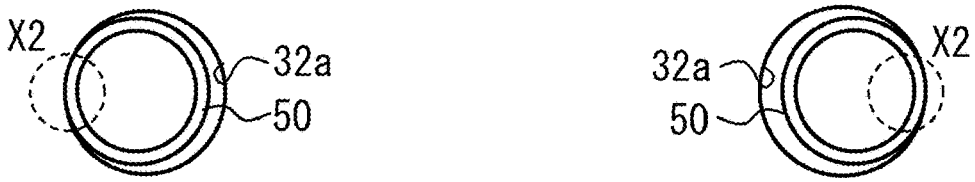
FIG. 6D is an explanatory view schematically illustrating a state in which an outer peripheral wall surface of a pin ring is in contact with an inner peripheral wall surface of the opening of the first cam cap bolt hole.

(Variation) Next, a variation will be described with reference to FIG. 6C and FIG. 6D. In the above embodiment, the minimum distances $S_{11a}$ and $S_{32a}$ have the relationship of $S_{11a}$ ($=S_{50}$)$<S_{32a}$. Further, the distance between the central axes $P_{AX11}$ is set to be shorter than the distance between the central axes $P_{AX32}$ of the pair of first cam cap bolt holes 32. Therefore, in the embodiment, the outer peripheral wall surface of the pin ring 50 and the inner peripheral wall surface of the first opening 32*a* of the first cam cap bolt hole 32 are in contact with each other in the region X1 located inside between the respective central axes.

In contrast, in the variation, the relationship of $R_{32a}>R_{11a}$ ($=R_{50}$) is satisfied. Further, the distance between the central axes $P_{AX32}$ is set to be shorter than the distance between the central axes $P_{AX11}$ of the pair of first cam cap bolt holes 32. Thus, in a region X2 located outside between the respective central axes, the outer peripheral wall surface of the pin ring 50 and the inner peripheral wall surface of the first opening 32*a* of the first cam cap bolt hole 32 are in contact with each other. Even if the dimensional relationship is changed in this manner, the first cam cap 30 is easily attached to the cylinder head body 10 while the first cam cap 30 is positioned with respect to the cylinder head body 10.

Such a change of the dimensional relationship may be performed in the relationship between the first cam cap 30 and the second cam cap 40.

According to the present embodiment, the pin ring 50 is press-fitted into one of the opening 11*a* of the head body bolt hole 11 and the first opening 32*a* of the first cam cap bolt hole 32, and is loosely fitted into the other. Further, the minimum distance between the openings 11*a* of the pair of head body bolt holes 11 is different from the minimum distance between the first openings 32*a* of the pair of first cam cap bolt holes 32. Thus, the first cam cap 30 is positioned with respect to the cylinder head body 10, and the first cam cap 30 is easily attached to the cylinder head body 10.

According to the present embodiment, the pin ring 60 is press-fitted into one of the second opening 32*b* of the first cam cap bolt hole 32 and the opening 42*a* of the second cam cap bolt hole 42, and is loosely fitted into the other. Further, the minimum distance between the second openings 32*b* of the pair of first cam cap bolt holes 32 is different from the minimum distance between the openings 42*a* of the pair of second cam cap bolt holes 42. Thus, the second cam cap 40 is positioned with respect to the first cam cap 30, and the second cam cap 40 can be easily attached to the first cam cap 30.

Although some embodiments of the present disclosure have been described in detail, the present disclosure is not limited to the specific embodiments but may be varied or changed within the scope of the present disclosure as claimed.

What is claimed is:

1. A camshaft mounting structure comprising:

a cylinder head body including at least a pair of head body bolt holes arranged in parallel;

a first cam cap, fastened in contact with the cylinder head body, including:

a pair of first cam cap bolt holes positionally corresponding to the pair of head body bolt holes; and a first support recess for supporting a camshaft; and a second cam cap, fastened in contact with the first cam cap, including:

a pair of second cam cap bolt holes positionally corresponding to the pair of first cam cap bolt holes; and a second support recess supporting the camshaft together with the first support recess, wherein the cylinder head body, the first cam cap, and the second cam cap are fastened by fastening bolts, the fastening bolt is inserted through the first cam cap bolt hole and the second cam cap bolt hole and is screwed into a screw thread portion provided in the head body bolt hole, a first positioning member having a cylindrical shape is disposed at a contact portion between the cylinder head body and the first cam cap so as to extend over an opening of the head body bolt hole and a first opening of the first cam cap bolt hole facing the opening of the head body bolt hole, one of an inner diameter of the opening of the head body bolt hole and an inner diameter of the first opening of the first cam cap bolt hole in which the first positioning member is disposed is larger than another of the inner diameter of the opening of the head body bolt hole and the inner diameter of the first opening of the first cam cap bolt hole, a minimum distance between the openings of the pair of head body bolt holes is different from a minimum distance between the first openings of the pair of first cam cap bolt holes, and an outer peripheral wall surface of the first positioning member is in contact with a part of an inner peripheral wall surface of the one of the opening of the head body bolt hole and the first opening of the first cam cap bolt hole.

2. The camshaft mounting structure according to claim 1, further comprising a second positioning member having a cylindrical shape and disposed at a contact portion between the first cam cap and the second cam cap so as to extend over a second opening of the first cam cap bolt hole and an opening of the second cam cap bolt hole facing the second opening of the first cam cap bolt hole, wherein one of an inner diameter of the second opening of the first cam cap bolt hole and an inner diameter of the opening of the second cam cap bolt hole in which the second positioning member is disposed is larger than another of the inner diameter of the second opening of the first cam cap bolt hole and the inner diameter of the opening of the second cam cap bolt hole, a minimum distance between the second openings of the pair of first cam cap bolt holes is different from a minimum distance between the openings of the pair of second cam cap bolt holes, and an outer peripheral wall surface of the second positioning member is in contact with a part of an inner peripheral wall surface of the one of the second opening of the first cam cap bolt hole and the opening of the second cam cap bolt hole.

3. The camshaft mounting structure according to claim 1, wherein the pair of first cam cap bolt holes is arranged to sandwich the first support recess, and the pair of second cam cap bolt holes is arranged to sandwich the second support recess.

4. The camshaft mounting structure according to claim 1, wherein when the minimum distance between the openings of the pair of head body bolt holes is shorter than the minimum distance between the first openings of the pair of first cam cap bolt holes, a distance between central axes of the pair of head body bolt holes is shorter than a distance between central axes of the pair of first cam cap bolt holes.

* * * * *